US010364521B2

(12) United States Patent
Lee et al.

(10) Patent No.: US 10,364,521 B2
(45) Date of Patent: Jul. 30, 2019

(54) OPERATING METHOD FOR WASHING MACHINE

(71) Applicant: LG ELECTRONICS INC., Seoul (KR)

(72) Inventors: Sangheon Lee, Changwon (KR); Heakyung Yoo, Changwon (KR); Deokkyu Kim, Changwon (KR); Sunku Kwon, Changwon (KR); Jaewon Chang, Changwon (KR); Byungkeol Choi, Changwon (KR); Hyojun Kim, Changwon (KR); Sunho Lee, Changwon (KR); Bonkwon Ko, Changwon (KR); Hangil Park, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 153 days.

(21) Appl. No.: 15/282,798

(22) Filed: Sep. 30, 2016

(65) Prior Publication Data

US 2017/0022646 A1 Jan. 26, 2017

Related U.S. Application Data

(63) Continuation of application No. 13/349,841, filed on Jan. 13, 2013, now abandoned.

(30) Foreign Application Priority Data

Jan. 14, 2011 (KR) ..... 10-2011-0004238
Jan. 14, 2011 (KR) ..... 10-2011-0004239

(51) Int. Cl.

| | |
|---|---|
| ***D06F 13/02*** | (2006.01) |
| ***D06F 35/00*** | (2006.01) |
| ***D06F 37/12*** | (2006.01) |

(52) U.S. Cl.
CPC ..... *D06F 13/02* (2013.01); *D06F 35/006* (2013.01); *D06F 37/12* (2013.01)

(58) Field of Classification Search
CPC ..... D06F 13/02
See application file for complete search history.

(56) References Cited

U.S. PATENT DOCUMENTS 4,232,536 A 11/1980 Koseki et al.
4,542,633 A 9/1985 Hirooka et al.
(Continued)

FOREIGN PATENT DOCUMENTS

CN 1391000 A 1/2003
CN 1521308 A 8/2004
(Continued)

OTHER PUBLICATIONS

International Search Report and Written Opinion dated Oct. 4, 2012 issued in Application No. PCT/KR2012/000286.
(Continued)

*Primary Examiner* — Jason Y Ko
(74) *Attorney, Agent, or Firm* — Ked & Associates LLP

(57) ABSTRACT

The present invention relates to an operation method of a washing machine for controlling the rotation of a pulsator to enhance cleaning performance, there is provided a method of operating a washing machine having a pulsator rotatably provided in a tub, and the method may include a first cleaning mode having a first process of rotating the pulsator in one direction at a first angle and then rotating it in the other direction at a second angle around the rotation shaft; and a second process of rotating the pulsator in the one direction at a third angle and then rotating it in the other direction at a fourth angle around the rotation shaft, wherein the first angle is greater than the third angle, and the second
(Continued)

angle is greater than the fourth angle, and the second angle is greater than the third angle.

12 Claims, 10 Drawing Sheets

(56) References Cited

U.S. PATENT DOCUMENTS

| | | | |
|---|---|---|---|
| 6,415,469 | B1 | 7/2002 | Diaz Fernandez et al. |
| 2003/0208855 | A1 | 11/2003 | McAllister et al. |

FOREIGN PATENT DOCUMENTS

| | | | |
|---|---|---|---|
| EP | 1 069 227 | A2 | 1/2001 |
| JP | 2004-065760 | A | 3/2004 |
| KR | 10-1988-0001643 | B1 | 9/1988 |
| KR | 10-1999-0019517 | A | 3/1999 |
| KR | 10-0229719 | B1 | 11/1999 |

OTHER PUBLICATIONS

Chinese Office Action dated Mar. 4, 2015 issued in Application No. 201280004247.X (with English translation).
U.S. Office Action issued in parent U.S. Appl. No. 13/349,841 dated Jul. 16, 2015.
U.S. Office Action issued in parent U.S. Appl. No. 13/349,841 dated Feb. 19, 2015.
U.S. Office Action issued in parent U.S. Appl. No. 13/349,841 dated Jun. 30, 2016.
European Search Report issued in Application 12734579.1 dated Dec. 1, 2017.

(a)

(b)

OPERATING METHOD FOR WASHING MACHINE

CROSS-REFERENCE TO RELATED APPLICATIONS

This application is a Continuation Application of prior U.S. patent application Ser. No. 13/349,841 filed Jan. 13, 2012, which claims priority under 35 U.S.C. § 119 to Korean Application Nos. 10-2011-0004238 and 10-2011-0004239 filed on Jan. 14, 2011, whose entire disclosures are hereby incorporated by reference.

BACKGROUND OF THE INVENTION

1. Field of the Invention

The present invention relates to an operation method of a washing machine for controlling the rotation of a pulsator to enhance cleaning performance.

2. Description of the Related Art

In general, washing machine refers to an apparatus for removing various contaminants adhered to cleaning objects such as clothes, bedclothes, and the like by a rubbing operation based on the emulsification and rotation of a detergent. The washing machine may be classified into a top load type washing machine in which a tub (or drum) is placed in the vertical direction and a front load type drum washing machine in which a tub (or drum) is placed in the horizontal direction.

Meanwhile, the top load type washing machine may allow cleaning objects to be placed from the top side, and the typical configuration thereof may include a cabinet forming an outer appearance of the washing machine, a tank accommodated in the cabinet to fill washing water, a tub accommodated in the tank to rotate during cleaning or dehydration, a pulsator rotatably provided at a bottom portion of the tub, and a drive portion for concurrently or separately driving the tub and pulsator.

The washing machine initiates the operation by putting cleaning objects and a detergent into the tub. When the operation of the washing machine is initiated, supplying washing water into the tub or tank is initiated, and detergent dissolving and cleaning cycles are initiated. In this case, water flows are formed by the rotation of a pulsator inside the tub or both the tub and pulsator to perform cleaning. Moreover, a dehydration cycle by the rotation of the tub can be carried out, and a drying cycle may be also carried out dependent on the device provided in a washing machine.

In general, the effect of cleaning to clean washing objects may vary based on various factors. Prior to the advent of a washing machine, hand washing may include knocking, rubbing, or kneading of cleaning objects. The means for transferring power to cleaning objects may include the formation of water flows (streams of water) by the rotation of the pulsator.

In other words, if water flows are formed by the rotation of the pulsator, then it may cause rubbing due to a relative speed of cleaning objects against water or rubbing between cleaning objects. Furthermore, the pulsator may be rotated to generate a twist of cleaning objects by water flows. A washing machine may clean cleaning objects by knocking, rubbing, and kneading them using water flows formed by the rotation of the pulsator. Accordingly, cleaning effect may be greatly affected by water flows generated by the rotation of the pulsator.

Meanwhile, a detergent may be put into the washing machine to remove contaminants in cleaning objects through the chemical action of the detergent in order to enhance cleaning effect. In this case, water flows by the rotation of the pulsator or the like may be also formed to uniformly soak the detergent into cleaning objects, thereby dispersing the detergent and changing the position or posture of cleaning objects to increase contact possibility to the detergent. In other words, the rotation of the pulsator may have a great effect on the enhancement of cleaning effect using a detergent.

The formation of water flows performing a key role in the cleaning process is mainly carried out by the rotation of the pulsator. FIG. 1 is a schematic diagram illustrating a rotation pattern of the pulsator in a washing machine in the related art. In case of a typical washing machine in the related art, only forward and reverse rotations may be merely repeated at a predetermined rotation angle ($\omega_0 * t_0$).

However, as described above, since the rotation of the pulsator has a great effect on the cleaning effect, there is a drawback in which a cleaning cycle suitable to cleaning objects made of various materials cannot be implemented by using only simple forward and reverse rotations. Further, there is a drawback in which the maximized cleaning effect on cleaning objects made of various materials cannot be expected.

SUMMARY OF THE INVENTION

An object of the present invention is to provide an operation method of a washing machine for controlling various rotations of an applicable pulsator based on cleaning objects, thereby enhancing cleaning effect.

More specifically, an object of the present invention is to provide an operation method of a washing machine for causing no damage of cleaning objects without causing fluff as well as transferring sufficient cleaning power even when cleaning high-class cleaning objects such as wool or silk, which allow no damage.

Furthermore, an object of the present invention is to provide an operation method of a washing machine for rotating a pulsator to transfer strong cleaning power to cleaning objects without causing damage during a cleaning cycle requiring strong cleaning power, thereby enhancing cleaning effect.

Furthermore, an object of the present invention is to provide an operation method of a washing machine for turning over cleaning objects to be uniformly dispersed within the tub to prevent the cleaning objects from being clumped or twisted, thereby enhancing cleaning effect.

Furthermore, an object of the present invention is to provide an operation method of a washing machine for allowing a detergent to be well soaked into and uniformly brought into contact with cleaning objects, thereby enhancing cleaning effect.

According to the present invention, there is provided a method of operating a washing machine having a pulsator rotatably provided in a tub, and the method may include a first cleaning mode having a first process of rotating the pulsator in one direction with a first angle and then rotating it in the other direction with a second angle around the rotation shaft; and a second process of rotating the pulsator in the one direction with a third angle and then rotating it in the other direction with a fourth angle around the rotation shaft, wherein the first angle is greater than the third angle, and the second angle is greater than the fourth angle, and the second angle is greater than the third angle.

According to an aspect of the present invention having the foregoing configuration, the pulsator may perform forward and reverse rotations with a large angle during the first process to form strong water flows and transfer strong cleaning power and large energy to cleaning objects, thereby enhancing cleaning effect, and the pulsator may perform forward and reverse rotations with a small angle during the second process to form weak water flows and transfer weak cleaning power and small energy to cleaning objects, thereby preventing cleaning objects from being damaged. If strong power is continuously transferred to cleaning objects to enhance cleaning effect, then the cleaning object may be damaged or excessively twisted to reduce cleaning effect, and thus the process is provided not to cause damage to the cleaning objects while transferring strong cleaning power.

Meanwhile, the first angle may be equal to the second angle. Furthermore, and the third angle may be equal to the fourth angle.

More preferably, the first angle may be at least two times greater than the third and the fourth angle, respectively. Otherwise, the second angle may be at least two times greater than the third and the fourth angle, respectively. An aspect of the foregoing configuration may be provided to increase a power and energy difference between the first process and the second process to maximize cleaning effect.

Here, it may be configured such that the first angle is 990°, the second angle 905°, the third angle 495°, and the fourth angle 495°.

The first cleaning mode may alternately implement the first and the second process at least twice.

The rotation of the pulsator with the first and second angle during the first process may generate a stronger twist to cleaning objects than that of the general angle by the rotation of water flows, and the rotation of the pulsator with the third and fourth angle during the second process may generate a weaker twist to cleaning objects than that of the general angle by the rotation of water flows.

Meanwhile, the method may further include a second cleaning mode in which the pulsator alternately performs forward and reverse rotations with a previously set general angle around the rotation shaft, wherein the first and the second angle are greater than the general angle, and the third and the fourth angle are less than the general angle. According to the foregoing configuration, a cleaning cycle that can be used as a standard without requiring a strong cleaning force as in the aforementioned first cleaning mode may be configured as a second cleaning mode to provide various rotation patterns of the pulsator.

Here, it may be configured such that the general angle is 720°.

Furthermore, the second cleaning mode may be implemented at least twice.

In this case, the first cleaning mode may be implemented between the second cleaning modes being implemented at least twice. Otherwise, the first and the second cleaning mode may be alternately implemented.

Meanwhile, the method may further include a third cleaning mode having a first circulation process of rotating the pulsator with a fifth angle in one direction around the rotation shaft; an idle process of suspending the rotation of the pulsator for a predetermined period of time subsequent to the first circulation process; and a second circulation process of rotating the pulsator with a sixth angle in the other direction around the rotation shaft subsequent to the idle process, wherein the idle process prevents a twist of cleaning objects caused by the rotation of water flows, and the first and the second circulation process circulates cleaning objects without causing a twist by the idle process.

According to an aspect of the present invention having the foregoing configuration, an idle process of suspending the rotation of the pulsator may be provided between the first circulation process and the second circulation process to reduce a twist generated on cleaning objects, and provide a time for cleaning objects to be uniformly dispersed within the tub while being rotated, and change the posture and position of cleaning objects such as turning over cleaning objects by an acceleration force generated when the rotation is started in a suspended state, thereby preventing the cleaning objects from being clumped or twisted, and allowing cleaning objects to be uniformly dispersed within the tub to enhance cleaning effect.

Furthermore, the operation method of a washing machine according to the present invention may further include a fourth cleaning mode having a first rotation process of rotating the pulsator with a seventh angle in one direction around the rotation shaft; and a second rotation process of rotating the pulsator with an eighth angle in the other direction around the rotation shaft, wherein the seventh angle is greater than the eighth angle, and the first and the second rotation process are alternately repeated at least twice to change the position and posture of cleaning objects in the tub.

According to an aspect of the present invention having the foregoing configuration, it may be configured to have different rotation angles for the first and the second rotation process performing forward and reverse rotations to allow cleaning objects to be continuously circulated within the tub by water flows received in any one direction. As a result, the cleaning objects may be uniformly dispersed within the tub while being rotated, and the posture and position of cleaning objects such as turning over cleaning objects may be changed by an acceleration force for which the rotation direction is switched, thereby preventing the cleaning objects from being clumped or twisted, and allowing cleaning objects to be uniformly dispersed within the tub to enhance cleaning effect.

Furthermore, the operation method of a washing machine according to the present invention may further include a speed variation mode of varying a speed from a first speed to a second speed to rotate the pulsator in one direction around the rotation shaft, wherein the second speed is greater than the first speed, and the first speed is a speed at which cleaning water inside the tub forms water flows to circulate cleaning objects, and the second speed becomes a speed at which cleaning water within the tub goes up along an inner wall of the tub and then falls down to a side of cleaning objects within the tub by a centrifugal force.

According to an aspect of the present invention having the foregoing configuration, the rotation speed of the pulsator may be periodically changed, thereby allowing cleaning water to go up along an inner wall of the tub and then fall down to a side of cleaning objects within the tub by a centrifugal force at high rotation speed. As a result, washing water may beat cleaning objects, thereby enhancing cleaning effect, and moreover, a detergent contained in washing water may be well dissolved, and the detergent may be well soaked into and uniformly brought into contact with cleaning objects, thereby enhancing cleaning effect.

Furthermore, there is provided a method of operating a washing machine having a pulsator rotatably provided in a tub, and the method may include a first cleaning mode having a first process of allowing cleaning objects to be strongly rubbed by a strong twist within the tub by the rotation of water flows generated by rotating the pulsator in one direction and then rotating it in the other direction around the rotation shaft; and a second process of allowing cleaning objects to be weakly rubbed by a weak twist within the tub by the rotation of water flows generated by rotating the pulsator in one direction and then rotating it in the other direction around the rotation shaft.

According to an aspect of the present invention having the foregoing configuration, cleaning objects may receive strong cleaning power by a forward and reverse rotation of the pulsator with a large angle during the first process to enhance cleaning effect, and receive weak cleaning power by a forward and reverse rotation of the pulsator with a small angle during the second process to prevent damage. If strong cleaning power and large energy are continuously transferred to cleaning objects to enhance cleaning effect, then the cleaning object may be damaged or excessively twisted to reduce cleaning effect, and thus the process is provided not to cause damage to the cleaning objects while transferring strong cleaning power.

According to the present invention, there is provided a method of operating a washing machine having a pulsator rotatably provided in a tub, and the method may include a divisional rotation mode having a first divisional rotation process of rotating the pulsator with a first end angle in one direction around the rotation shaft; and a second divisional rotation process of rotating the pulsator with a second end angle in the other direction, wherein the first divisional rotation process divides the first end angle into at least two angles to rotate the pulsator, and the second divisional rotation process divides the second end angle into at least two angles to rotate the pulsator.

An aspect of the present invention having the foregoing configuration, power and energy transferred to cleaning objects to implement cleaning may be divided and transferred to the cleaning objects. If power is continuously transferred to cleaning objects to enhance cleaning effect, then the cleaning object may be damaged or excessively twisted to reduce cleaning effect, and thus the process is provided not to cause damage to the cleaning objects while transferring cleaning power. As a result, the cleaning objects may receive continuous acceleration and deceleration by dividing a rotation angle to implement cleaning while being slightly shaken within the tub by water flows, thereby preventing damage.

According to the present invention, the pulsator may perform forward and reverse rotations with a large angle to form strong water flows and transfer strong cleaning power and large energy to cleaning objects, thereby enhancing cleaning effect, and then the pulsator may perform forward and reverse rotations with a small angle to form weak water flows and transfer weak cleaning power to cleaning objects, thereby preventing cleaning objects from being damaged. As a result, cleaning objects may not be damaged while transferring strong cleaning power to the cleaning objects, thereby enhancing cleaning effect.

Furthermore, according to the present invention, the rotation of the pulsator may be suspended between forward and reverse rotations to reduce a twist of cleaning objects and allow the cleaning objects to be uniformly dispersed within the tub while being rotated, and change the posture and position of the cleaning objects, thereby enhancing cleaning effect.

Furthermore, according to the present invention, it may be configured to have different rotation angles for forward and reverse rotations to allow cleaning objects to be continuously circulated within the tub by water flows received in any one direction. As a result, the cleaning objects may be uniformly dispersed within the tub while being rotated, and the posture and position of cleaning objects may be changed to enhance cleaning effect.

Furthermore, according to the present invention, power and energy transferred to cleaning objects to implement cleaning may be divided and transferred to the cleaning objects. If power is continuously transferred to cleaning objects to enhance cleaning effect, then the cleaning object may be damaged or excessively twisted to reduce cleaning effect, and thus the cleaning objects may receive continuous acceleration and deceleration by intermittently transferring cleaning power to cleaning objects to perform cleaning while being slightly shaken within the tub, thereby preventing damage.

Furthermore, according to the present invention, the rotation speed of the pulsator may be periodically changed, thereby allowing cleaning water to go up along an inner wall of the tub and then fall down to a side of cleaning objects within the tub by a centrifugal force at high rotation speed. As a result, washing water may beat cleaning objects to enhance cleaning effect, and moreover, a detergent contained in washing water may be well dissolved, and the detergent may be well soaked into and uniformly brought into contact with cleaning objects, thereby enhancing cleaning effect.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Hereinafter, detailed description for implementing the present invention through embodiments of the present invention will be described with reference to the accompanying drawings.

Figure 1:
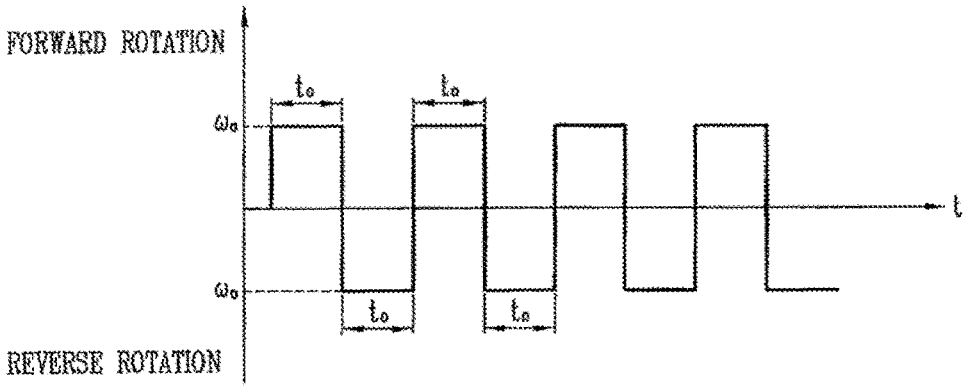
FIG. 1 is a diagram illustrating the rotation pattern of a pulsator in a typical washing machine in the related art.
Figure 2:
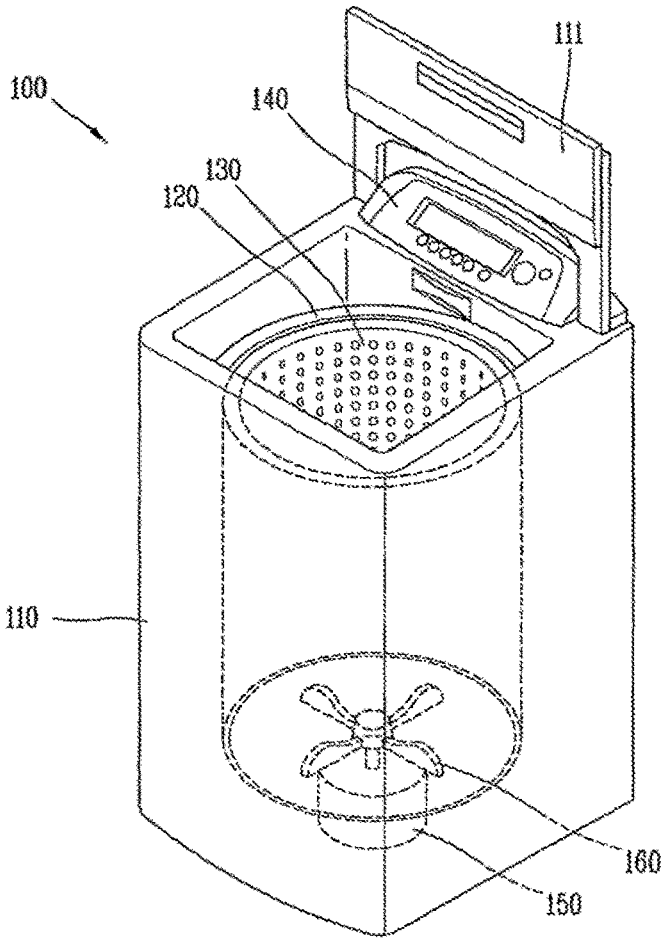
FIG. 2 is a schematic view illustrating a washing machine to which an operation method of the washing machine of the invention is applicable.

FIG. 2 is a schematic view illustrating a washing machine to which an operation method of the washing machine of the invention is applicable. However, though FIG. 2 illustrates a schematic view of a top load type washing machine, the present invention will not be limited to this, but a top load type washing machine will be used for illustration, for the sake of convenience of explanation.

Referring to FIG. 2, a washing machine 100 to which an operation method of the invention is applicable may include a cabinet 110 forming an outer appearance of the washing machine, a tank 120 accommodated in the cabinet to fill washing water, a tub 130 accommodated in the tank 120 to be rotated during the cleaning or dehydration, a pulsator 160 rotatably provided at the bottom of the tub to form water flows within the tub, and a drive unit 150 configured to simultaneously or individually drive the tub and pulsator.

An upper portion of the cabinet may be open to put cleaning objects into the tub accommodated therein. Accordingly, a top cover 111 may be provided at an upper portion of the cabinet to open or close an upper portion of the cabinet open during the cleaning.

Meanwhile, a control panel 140 that can be controlled by a user may be provided to operate the washing machine by selecting a cleaning cycle or the like. The control panel 140 may be provided with a display unit to allow the user to check the operation status and information thereof. Furthermore, a control box (not shown) may be provided thereinside to control devices by the user's input.

The present invention relates to an operation method of a washing machine used in the washing machine having the foregoing configuration to enhance cleaning effect, and more particularly, to a method of controlling the rotation of the pulsator 160 to enhance cleaning effect. The control of the pulsator 160 may be implemented by the control box according to a command which is input or previously input by the user through the control panel 140.

The pulsator 160 may be connected to a rotation shaft of a drive motor constituting the drive unit 150 for rotation. Accordingly, the control of the pulsator may be carried out by controlling the drive motor. More specifically, a microcomputer (not shown) may be provided in the control box, and the microcomputer may be electrically connected to the drive motor and a sensor provided in the drive motor to control the rotation of the drive motor. In other words, the operation of the drive motor sensed by the sensor may be transferred as a signal to control the operation of the drive motor. Moreover, the microcomputer may be electrically connected to various sensors and a valve provided in the washing machine to control them.

The drive motor used in the washing machine of the invention preferably may be a direct-drive motor for accurate control. Furthermore, the rotation control of the drive motor may be preferably carried out by using a current control scheme to accurately control a pulsator being rotated by the drive motor.

The device description and current control for controlling the pulsator are typically used and thus the detailed description thereof will be omitted, and a detailed method of operating a washing machine will be described below through embodiments of the present invention around the operation of a pulsator to form water flows.

Embodiment 1

Figure 3:
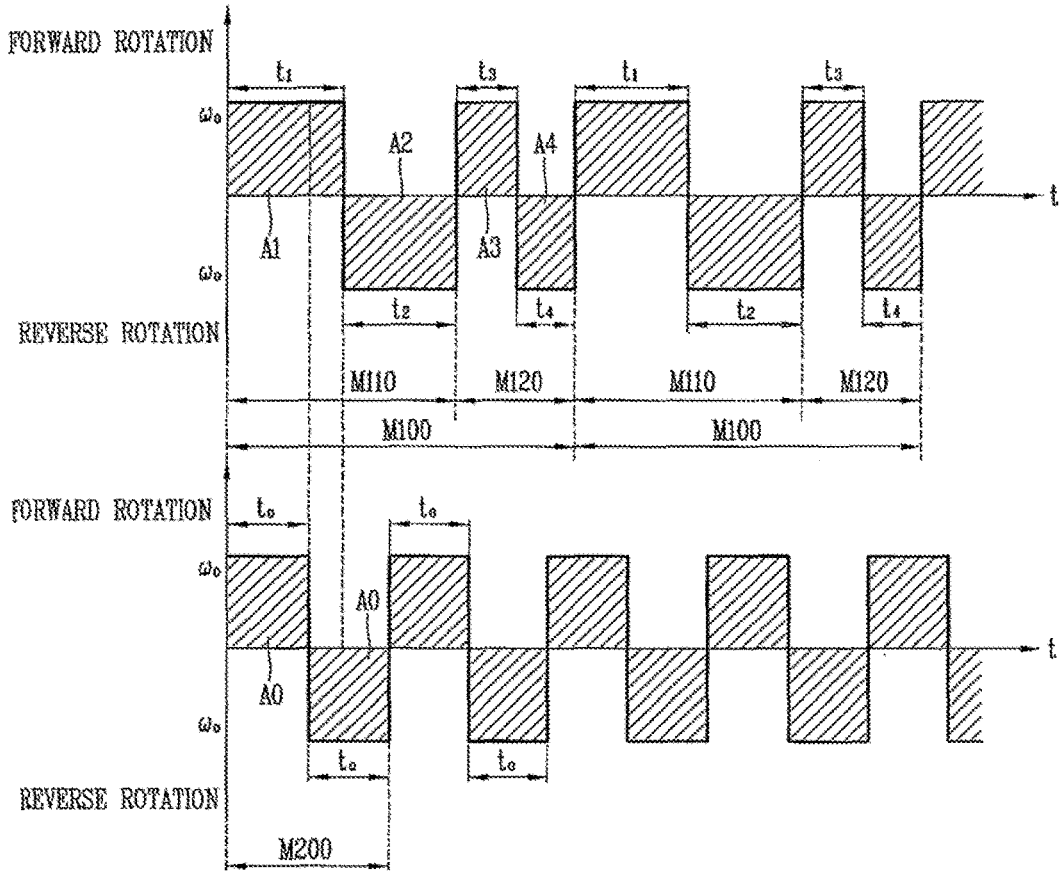
FIG. 3 is a diagram illustrating the rotation pattern of a pulsator according to Embodiment 1 of the present invention.
Figure 4:
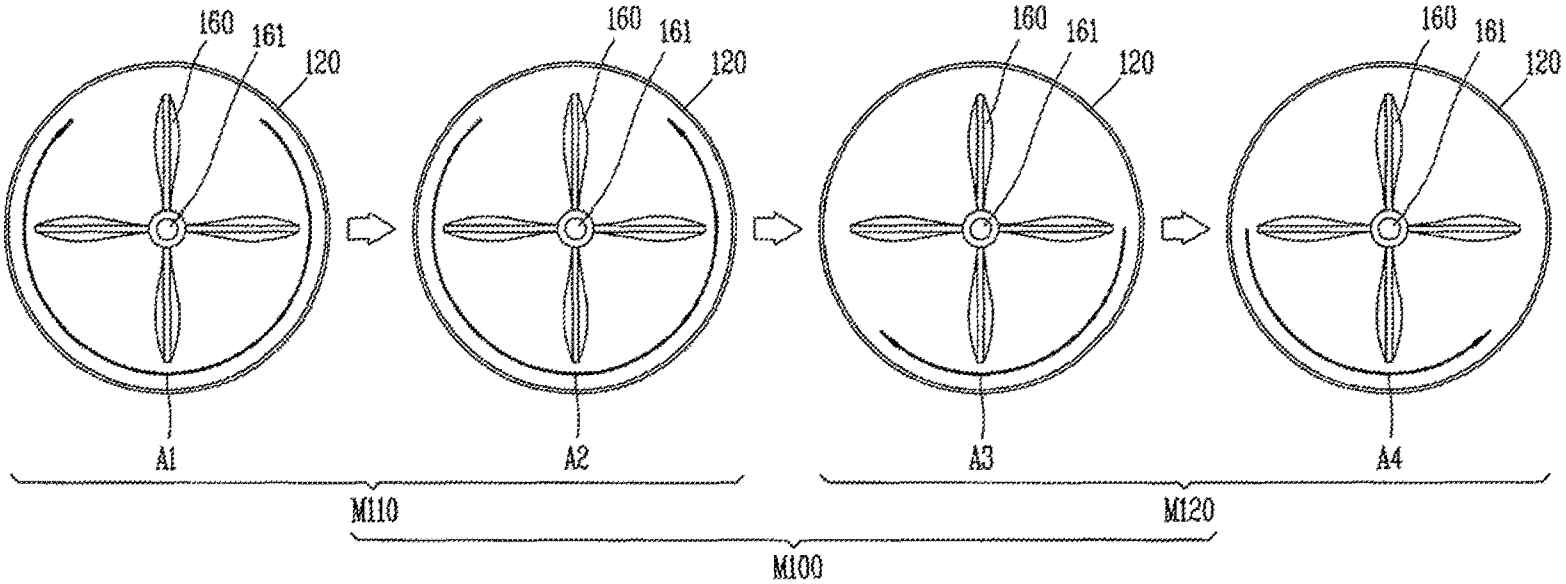
FIG. 4 is a schematic view illustrating the operation of a pulsator according to Embodiment 1 of the present invention.

FIG. 3 is a diagram illustrating the rotation pattern of a pulsator according to this embodiment, and FIG. 4 is a schematic view illustrating the operation of a pulsator according to this embodiment.

An operation method of a washing machine according to this embodiment may include a first cleaning mode (M100) having a first process (M110) of rotating the pulsator in one direction with a first angle (A1) and then rotating it in the other direction with a second angle (A2) around the rotation shaft, and a second process (M120) of rotating the pulsator in the one direction with a third angle (A3) and then rotating it in the other direction at a fourth angle (A4) around the rotation shaft.

Here, the one direction and the other direction designate a forward rotation and reverse rotation or a clockwise direction rotation and counter-clockwise directional rotation, respectively, around the rotation shaft 161 of the pulsator. However, it does not designate a specific directivity, but merely denotes that the forward and reverse rotations are sequentially carried out for the first process, and does not limit the rights scope of the present invention for the specific directivity.

The first cleaning mode (M100) may include a first process (M110) and a second process (M120).

Referring to FIG. 4, the first process (M110) is consisted of forward and reverse rotations of the pulsator 160 to rotate the pulsator in one direction with a first angle (A1) and then rotate it in the other direction with a second angle (A2). Furthermore, the second process (M120) is consisted of forward and reverse rotations of the pulsator 160 to rotate the pulsator in one direction with a third angle (A3) and then rotate it in the other direction with a fourth angle (A4). In FIG. 4, an arrow does not denote the size of a specific rotation angle but merely denote only a rotation direction and a relative size thereof.

Here, it may be configured such that the first angle (A1) is greater than the third angle (A3), and the second angle (A2) is greater than the fourth angle (A4). Furthermore, it may be configured such that the second angle is greater than the third angle.

If the pulsator rotates within the tub, washing water is rotated by the pulsator. Due to a viscosity resistance of the fluid, however, washing water does not rotate at the same angle as that of the pulsator but does form water flows, and the rotation angle thereof gradually changes from a water region adjacent to the pulsator or adjacent to an inner surface of the tub. In other words, washing water exhibits the motion such as a whirlpool when viewed from an upper side of the tub.

The cleaning objects may be rotated in a floating state within washing water by such water flows. However, the cleaning objects may not exhibits the motion completely matched to the water flows, but may be twisted or clumped by the position, weight, posture or the like of the cleaning objects. The cleaning objects may be receive power caused by a twist or the like of the cleaning objects to perform cleaning.

Moreover, since cleaning objects does not exhibit the motion completely matched to water flows, and the cleaning objects may receive rubbing caused by a relative speed with respect to washing water or caused by a contact between cleaning objects.

Meanwhile, water flows may be affected by a rotation angle of the pulsator. In other words, if the pulsator rotates with a large rotation angle, then a large and strong whirlpool may be formed by a difference between the central portion and outer portion of washing water.

During the first process (M110) of this embodiment, the pulsator performs a forward and reverse rotation with a large angle to form strong water flows. As described above, high power or energy are transferred to cleaning objects. It may be represented by a level of cleaning at which the cleaning objects receive rubbing caused by a twist or the like. Accordingly, during the first process, the level of cleaning at which the cleaning objects receive power is high, thereby enhancing cleaning effect.

However, during the second process (M120) of this embodiment, the pulsator performs a forward and reverse rotation with a small angle to form weak water flows. Accordingly, low power or energy are transferred to cleaning objects. The cleaning effect may increase when high energy and power are transferred to cleaning objects, but it may also cause damage on cleaning objects because the cleaning objects receive a high level of rubbing. As a result, if a lot of energy and power are transferred to receive a high level of rubbing as in the first process, the cleaning objects may get damaged. The second process is provided to prevent this, high power may not be continuously transferred to cleaning objects even if the cleaning effect is reduced, thereby preventing the cleaning objects from being damaged.

Moreover, the first cleaning mode (M100) may be configured to alternately implement the first process (M110) and the second process (M120) at least twice. In other words, the first and the second process are sequentially repeated.

In the upper part of the diagram of FIG. 3, the pulsator rotates at a constant rotation speed $\omega_0$. If a forward rotation is carried out for a time t1 during the first process and a reverse rotation is carried out for a time t2 during the first process, then the first angle (A1) and second angle (A2) correspond to an area for times t1 and t2, respectively, in FIG. 3. Similarly, the third angle (A3) and fourth angle (A4) correspond to an area for times t3 and t4, respectively. As illustrated in FIG. 3, an area corresponding to the first and the second angle is greater than that of the third and the fourth angle. It means that the corresponding energy and power are transferred.

In the first cleaning mode (M100), as described above, strong cleaning effect is exhibited during the first process and high energy and power is not continuously transferred to cleaning objects during the second process. However, the cleaning effect of the first cleaning mode is not reduced by the second process. In other words, the first process may be carried out again by periodically repeated first cleaning modes, thereby allowing the cleaning objects to receive high energy and power once again.

The cleaning effect may not simply be determined only by a sum of transferred energy but may vary depending on a level of transferred power. In other words, contaminants adhered to cleaning objects cannot be removed by continuously applied low power and energy but can be removed by applying high power and energy at a certain time. Accordingly, high power may be transferred through the first process even if the power and energy are reduced through the second process, thereby enhancing the overall cleaning effect of the first cleaning mode. Furthermore, the cleaning objects may not be damaged while transferring high cleaning power.

Meanwhile, it may be configured such that the first angle is at least two times greater than the third and the fourth angle, respectively. Furthermore, it may be configured such that the second angle is at least two times greater than the third and the fourth angle, respectively. According to an aspect of the foregoing configuration, a difference of the power and energy transferred between the first and the second process may be increased to maximize cleaning effect and reduce the damage of cleaning objects to the maximum.

Furthermore, it may be configured such that the first angle is equal to the second angle and the third angle is equal to the fourth angle. For example, it may be configured such that the first angle is 990°, the second angle 990°, the third angle 495°, and the fourth angle 495°.

Meanwhile, an additional cleaning mode may be provided to be a reference to the first cleaning mode. In other words, it may further include a second cleaning mode (S200) in which the pulsator alternately performs forward and reverse rotations with a general angle (A0) around the rotation shaft. It is illustrated in the lower part of the diagram of FIG. 3.

Referring to the lower part of the diagram of FIG. 3, the first angle (A1) and second angle (A2) are greater than the general angle (A0), and the third angle (A3) and fourth angle (A4) are less than the general angle (A0). Through such a configuration, a cleaning cycle that can be used as a standard without requiring strong cleaning power as in the foregoing first cleaning mode may be configured with a second cleaning mode to provide various rotation patterns of the pulsator.

Here, the rotation of the pulsator with the first and the second angle during the first process may generate a strong twist to cleaning objects than that of the general angle (A0) by the rotation of water flows. In other words, high power may be transferred to the cleaning objects. Accordingly, the first process may have an excellent cleaning effect compared to the second cleaning mode (M200). Furthermore, the rotation of the pulsator with the third and the fourth angle during the second process may generate a weak twist to cleaning objects than that of the general angle (A0) by the rotation of water flows. Accordingly, the second process may prevent the cleaning object from being damaged.

As an example of the second cleaning mode, it may be configured such that the general angle is 720°. In other words, compared to the foregoing example of the first cleaning mode, it may be configured such that the first and the second angle are 990° which is greater than the general angle 720° during the first process of the first cleaning mode, and the third and the fourth angle are 495° which is less than the general angle 720° during the second process.

Meanwhile, it may be configured to implement the second cleaning mode (M200) at least twice. In other words, the second cleaning mode may be repeated. Here, it may be configured such that the first cleaning mode is implemented between the second cleaning modes being implemented at least twice. Otherwise, it may be also configured such that the first and the second cleaning mode are alternately implemented.

Embodiment 2

Figure 5:
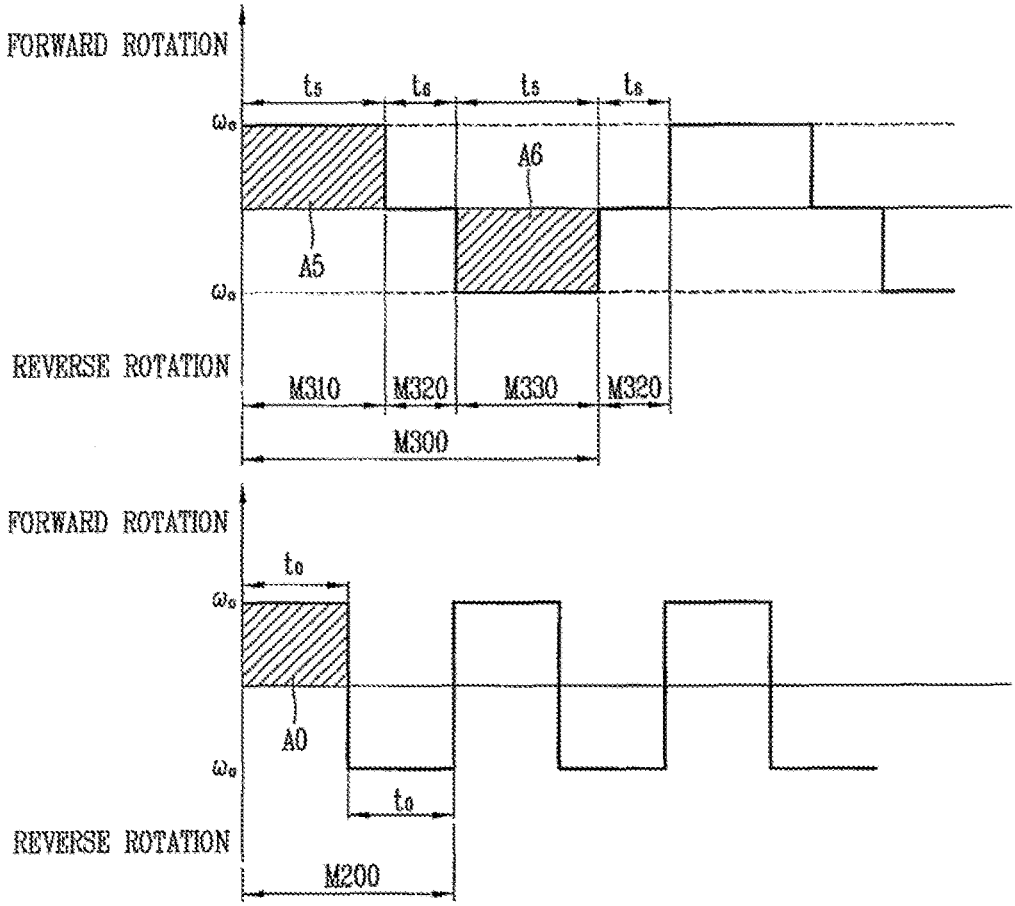
FIG. 5 is a diagram illustrating the rotation pattern of a pulsator according to Embodiment 2 of the present invention.
Figure 6:
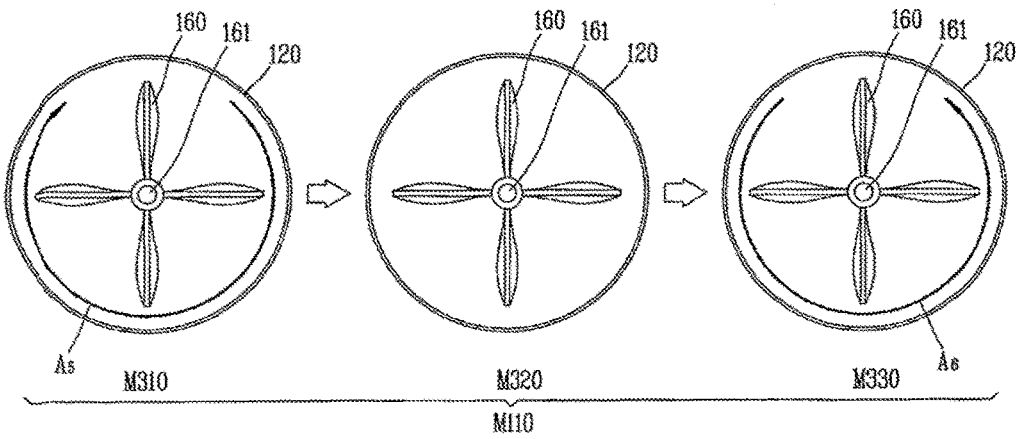
FIG. 6 is a schematic view illustrating the operation of a pulsator according to Embodiment 2 of the present invention.

FIG. 5 is a diagram illustrating the rotation pattern of a pulsator according to this embodiment, and FIG. 6 is a schematic view illustrating the operation of a pulsator according to this embodiment.

An operation method of a washing machine according to this embodiment may include a third cleaning mode (M300) having a first circulation process (M310) of rotating the pulsator with a fifth angle (A5) in one direction around the rotation shaft, an idle process (M320) of suspending the rotation of the pulsator for a predetermined period of time (ts) subsequent to the first circulation process, and a second circulation process (M330) of rotating the pulsator with a sixth angle (A6) in the other direction around the rotation shaft subsequent to the idle process.

Here, the one direction and the other direction designate a forward rotation and reverse rotation or a clockwise direction rotation and counter-clockwise directional rotation, respectively, around the rotation shaft 161 of the pulsator. However, it does not designate a specific directivity, but merely denotes that the forward and reverse rotations are sequentially carried out for the first process, and does not limit the rights scope of the present invention for the specific directivity.

The third cleaning mode (M300) may be configured to sequentially implement the first circulation process (M310), the idle process (M320), and the second circulation process (M330).

Referring to FIG. 6, the first circulation process (M310) is consisted of one direction rotation of the pulsator 160 to rotate the pulsator in one direction with a fifth angle (A5). The idle process (M320) is consisted of the other direction rotation of the pulsator 160 to rotate the pulsator in the other direction with a sixth angle (A6). In FIG. 6, an arrow does not denote the size of a specific rotation angle but merely denote only a rotation direction and a relative size thereof. Here, an idle process (M320) of suspending the rotation of the pulsator for a predetermined period of time (ts) may be carried out between the first and the second circulation process.

As described above, if the pulsator rotates within the tub, washing water is rotated by the pulsator. Accordingly, the washing water forms water flows, and the cleaning objects may not exhibit the motion completely matched to the water flows, but may be twisted or clumped by the position, weight, posture or the like of the cleaning objects.

Though cleaning objects receive power by a twist of the cleaning objects to perform cleaning, rubbing received by the cleaning objects may be large to cause damage on the cleaning objects. Moreover, the cleaning objects may be twisted or clumped to be located only at a specific point within the tub. If so, the cleaning objects may not be brought into contact with a detergent and the power and energy may not be uniformly transferred to the cleaning objects, thereby reducing cleaning effect.

Accordingly, the idle process (M320) provides spare time capable of preventing a twist of the cleaning objects by the rotation of water flows and allowing the cleaning objects to be uniformly dispersed within the tub. As a result, even if high power and energy are transferred by the first and the second circulation process, the cleaning objects may be simply rotated only by the rotation of water flows during the idle process, thereby naturally removing the twist or the like.

Moreover, if the pulsator starts to rotate in a suspended state caused by the idle process, the cleaning objects instantaneously receive power caused by reverse direction water flows by an acceleration force, thereby changing the posture and position of the cleaning objects, such as their turnover or the like. It may allow a detergent to be efficiently brought into contact with the cleaning objects, thereby enhancing cleaning effect.

In order to maintain the foregoing effect, the third cleaning mode (M300) may be repeatedly carried out at least twice. In this case, as illustrated in the upper part of the diagram of FIG. 5, the idle process (M320) may be preferably carried out between the second circulation process and the subsequently implemented first circulation process.

In the upper part of the diagram of FIG. 5, the pulsator rotates at a constant rotation speed $\omega_0$. A forward rotation is carried out for a time t5 during the first circulation process, an idle process is carried out for a time ts, and a reverse rotation is carried out for a time t6 during the second circulation process. Here, the fifth angle (A5) and sixth angle (A6) correspond to an area for times t5 and t6, respectively, in FIG. 5. It means that the corresponding energy and power are transferred.

Here, the third cleaning mode may be alternately carried out with the foregoing second cleaning mode. In this case, the fifth angle (A5) and sixth angle (A6) may be preferably greater than the general angle (A0). Referring to the lower part of the diagram of FIG. 5, the fifth angle (A5) and sixth angle (A6) are greater than the general angle (A0). It may be understood by comparing the corresponding areas to each angle with each other.

Accordingly, the rotation of the pulsator during the first and the second circulation process may generate a strong twist to the cleaning objects by the rotation of water flows, compared to the general angle (A0), thereby allowing the third cleaning mode (M300) to have an excellent cleaning effect compared to the second cleaning mode (M200). However, the third cleaning mode (M300) may circulate cleaning objects within the tub more efficiently than the second cleaning mode (M200), thereby improving the cleaning effect.

In order to improve the cleaning effect compared to the second cleaning mode with a typical rotation, such a configuration may reduce a twist of cleaning objects while transferring strong cleaning power and high energy to the cleaning objects, and change the posture and position of the cleaning objects, and prevent a crump of the cleaning objects, thereby allowing the cleaning objects to be uniformly distributed within the tub.

Here, it may be configured such that the fifth angle is equal to the sixth angle. For example, the fifth and the sixth angle may be 990°. In this case, a predetermined time (ts) of the idle process should be a sufficient time to generate the foregoing effect to cleaning objects. For example, it may be configured such that a predetermined time (ts) of the idle process is 0.3 second.

Meanwhile, it may be configured to alternately implement the third and the first cleaning mode. Moreover, it may be configured to implement all the first, the second, and the third cleaning mode in a combined manner. The processes may be combined with one another in various ways according to the kind of cleaning objects and the progressive level of cleaning.

Embodiment 3

Figure 7:
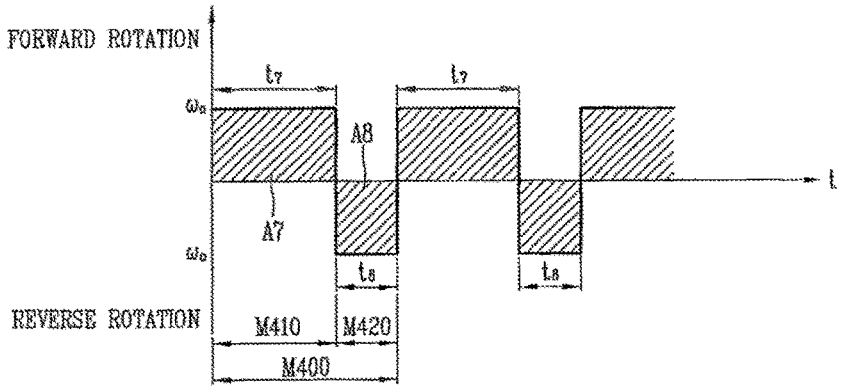
FIG. 7 is a diagram illustrating the rotation pattern of a pulsator according to Embodiment 3 of the present invention.
Figure 8:
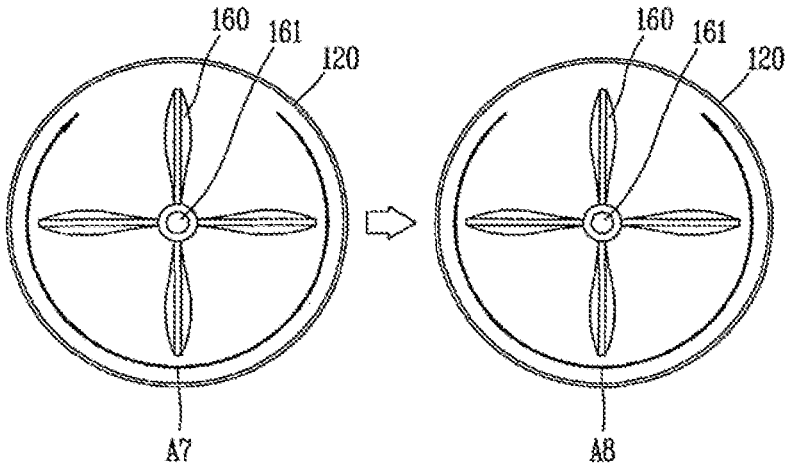
FIG. 8 is a schematic view illustrating the operation of a pulsator according to Embodiment 3 of the present invention.

FIG. 7 is a diagram illustrating the rotation pattern of a pulsator according to this embodiment, and FIG. 8 is a schematic view illustrating the operation of a pulsator according to this embodiment.

An operation method of a washing machine according to this embodiment may include a fourth cleaning mode having a first rotation process (M410) of rotating the pulsator with a seventh angle (A7) in one direction around the rotation shaft, and a second rotation process (M420) of rotating the pulsator with an eighth angle (A8) in the other direction around the rotation shaft, wherein the seventh angle (A7) is greater than the eighth angle (A8).

Here, the one direction and the other direction designate a forward rotation and reverse rotation or a clockwise direction rotation and counter-clockwise directional rotation, respectively, around the rotation shaft 161 of the pulsator. However, it does not designate a specific directivity, but merely denotes that the forward and reverse rotations are sequentially carried out for the first process, and does not limit the rights scope of the present invention for the specific directivity.

The fourth cleaning mode (M400) may be configured to sequentially implement the first rotation process (M410), and the second rotation process (M420).

Referring to FIG. 8, the first rotation process (M410) is consisted of one direction rotation of the pulsator 160 to rotate the pulsator in one direction with a seventh angle (A7). The second rotation process (M420) is consisted of the other direction rotation of the pulsator 160 to rotate the pulsator in the other direction with an eighth angle (A8). In FIG. 8, an arrow does not denote the size of a specific rotation angle but merely denote only a rotation direction and a relative size thereof.

Here, it may be configured such that the seventh angle (A7) is greater than the eighth angle (A8). Referring to FIG. 7, the pulsator rotates at a constant rotation speed $\omega_0$. A forward rotation is carried out for a time t7 during the first rotation process (M410), and a reverse rotation is carried out for a time t8 during the second rotation process (M420). Here, the seventh angle (A7) and eighth angle (A8) correspond to an area for times t7 and t8, respectively, in FIG. 7. It means that the corresponding energy and power are transferred.

The foregoing configuration may have different rotation angles for the first and the second rotation process performing forward and reverse rotations to allow cleaning objects to be continuously circulated within the tub by water flows received in any one direction. As a result, the cleaning objects may be uniformly dispersed within the tub while being rotated, and the posture and position of cleaning objects such as turning over cleaning objects may be changed by an acceleration force for which the rotation direction is switched, thereby preventing the cleaning objects from being clumped or twisted, and allowing cleaning objects to be uniformly dispersed within the tub to enhance cleaning effect.

Furthermore, according to this embodiment, it may be configured such that the first and the second rotation process are alternately repeated at least twice. In other words, the fourth cleaning mode may be repeated. In this case, the position and posture of cleaning objects may be changed within the tub, thereby allowing the cleaning objects to be circulated as described above.

In this embodiment, it may be configured such that the seventh angle is at least two times greater than the eighth angle. For example, it may be configured such that the seventh angle is 720° and the eighth angle is 360°. According to an aspect of the configuration, a difference of the power and energy transferred between the first and the second circulation process may be increased to increase an acceleration force transferred to the cleaning objects when switching the rotation direction. Accordingly, the posture and position of cleaning objects such as turning over cleaning objects may be changed as described above, thereby preventing the cleaning objects from being clumped or twisted, and allowing cleaning objects to be uniformly dispersed within the tub to enhance cleaning effect.

Meanwhile, it may be configured to alternately implement the fourth and the second cleaning mode. Moreover, it may be configured to implement all the fourth, the first, the second, and the third cleaning mode in a combined manner. The processes may be combined with one another in various ways according to the kind of cleaning objects and the progressive level of cleaning to maximize cleaning effect.

Embodiment 4

Figure 9:
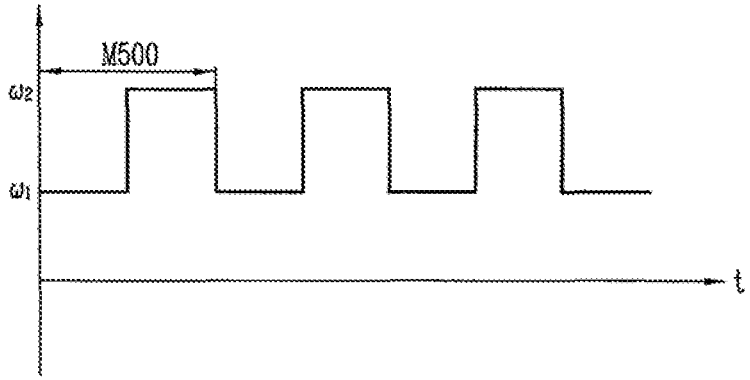
FIG. 9 is a diagram illustrating the rotation pattern of a pulsator according to Embodiment 4 of the present invention.
Figure 10:
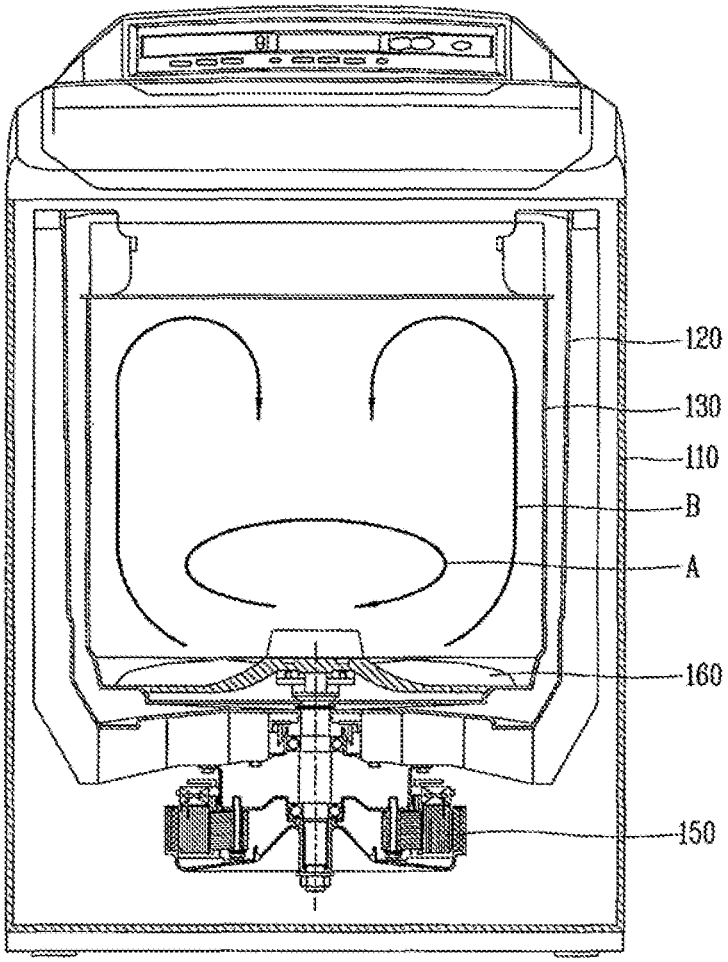
FIG. 10 is a schematic view illustrating the operation of a pulsator according to Embodiment 4 of the present invention.

FIG. 9 is a diagram illustrating the rotation pattern of a pulsator according to this embodiment, and FIG. 10 is a schematic view illustrating the operation of a pulsator according to this embodiment.

An operation method of a washing machine according to this embodiment may include a speed variation mode (M500) of varying a speed from a first speed (ω1) to a second speed (ω2) to rotate the pulsator in one direction around the rotation shaft, Here, the second speed (ω2) is greater than the first speed (ω1), and the first speed (ω1) is a speed at which cleaning water inside the tub forms water flows to circulate cleaning objects, and the second speed (ω2) is a speed at which cleaning water within the tub goes up along an inner wall of the tub and then falls down to a side of cleaning objects within the tub by a centrifugal force.

Referring to FIG. 10, cleaning water within the tub merely forms water flows at the first speed (ω1) as illustrated in an arrow A. However, cleaning water within the tub goes up along an inner wall of the tub and then falls down to a side of cleaning objects within the tub by a centrifugal force at the second speed (ω2) as illustrated in an arrow B of FIG. 10. As a result, washing water may beat cleaning objects, thereby enhancing cleaning effect, and moreover, a detergent contained in washing water may be well dissolved, and the detergent may be well soaked into and uniformly brought into contact with cleaning objects, thereby enhancing cleaning effect.

The speed variation mode (M500) may be configured to alternately implement the first and the second speed at least once. In other words, as illustrated in FIG. 9, the speed variation mode (M500) may be repeatedly carried out. Referring to FIG. 9, the pulsator rotates at the first speed and then the rotation speed is changed to the second speed after a predetermined period of time.

For example, it may be configured such that the first speed is 110 rpm and the second speed is 150 rpm. The second speed is experimentally selected as a value such that cleaning water can form water flows in the tub on the basis of a typically used capacity of the washing machine as illustrated in an arrow B of FIG. 10.

According to this embodiment having the foregoing configuration, the rotation speed of the pulsator may be periodically changed, thereby allowing cleaning water to go up along an inner wall of the tub and then fall down to a side of cleaning objects within the tub by a centrifugal force at high rotation speed. As a result, washing water may beat cleaning objects, thereby enhancing cleaning effect, and moreover, a detergent contained in washing water may be well dissolved, and the detergent may be well soaked into and uniformly brought into contact with cleaning objects, thereby enhancing cleaning effect.

Meanwhile, the speed variation mode (M500) may be configured to implement all the first, the second, the third, and the fourth cleaning mode in a combined manner. The processes may be combined with one another in various ways according to the kind of cleaning objects and the progressive level of cleaning to maximize cleaning effect.

Embodiment 5

Figure 11:
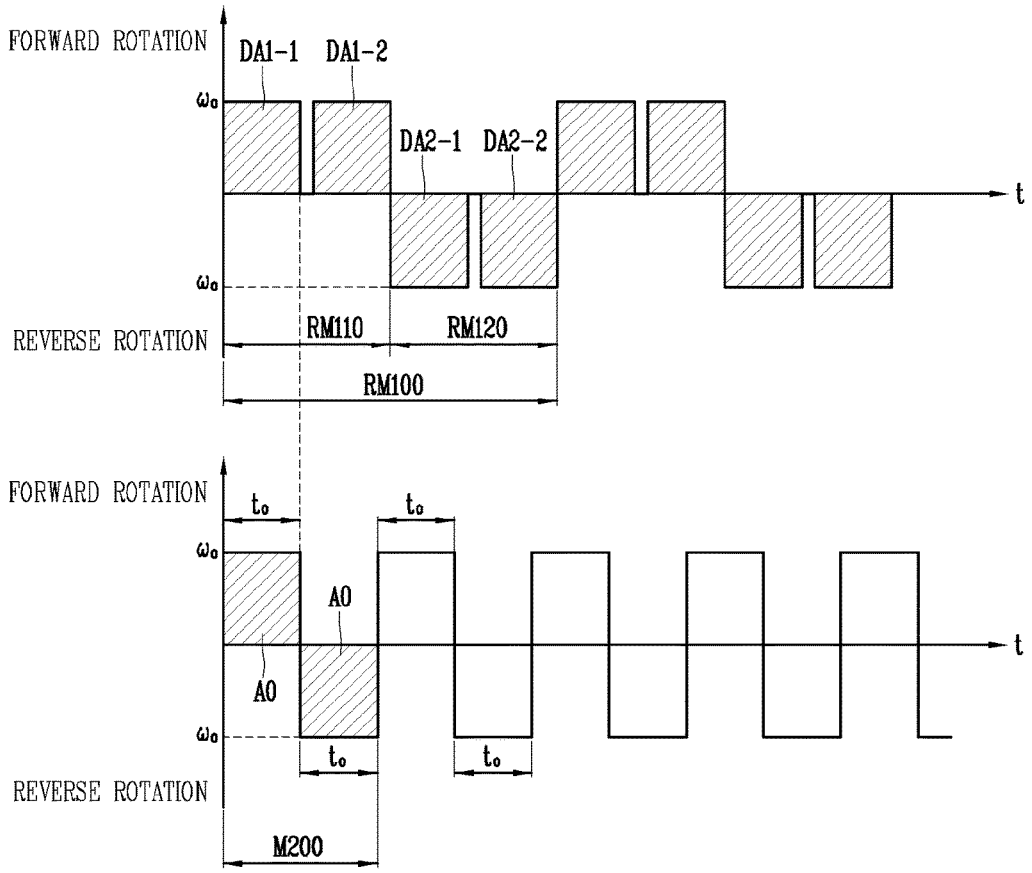
FIGS. 11(*a*) and 11(*b*) are diagrams illustrating a two divisional rotation pattern of a pulsator according to Embodiment 5 of the present invention.
Figure 11:
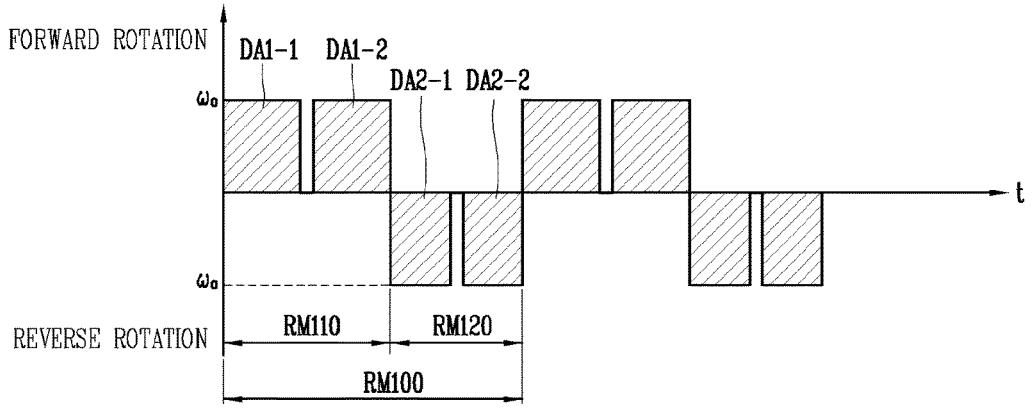
Figure 12:
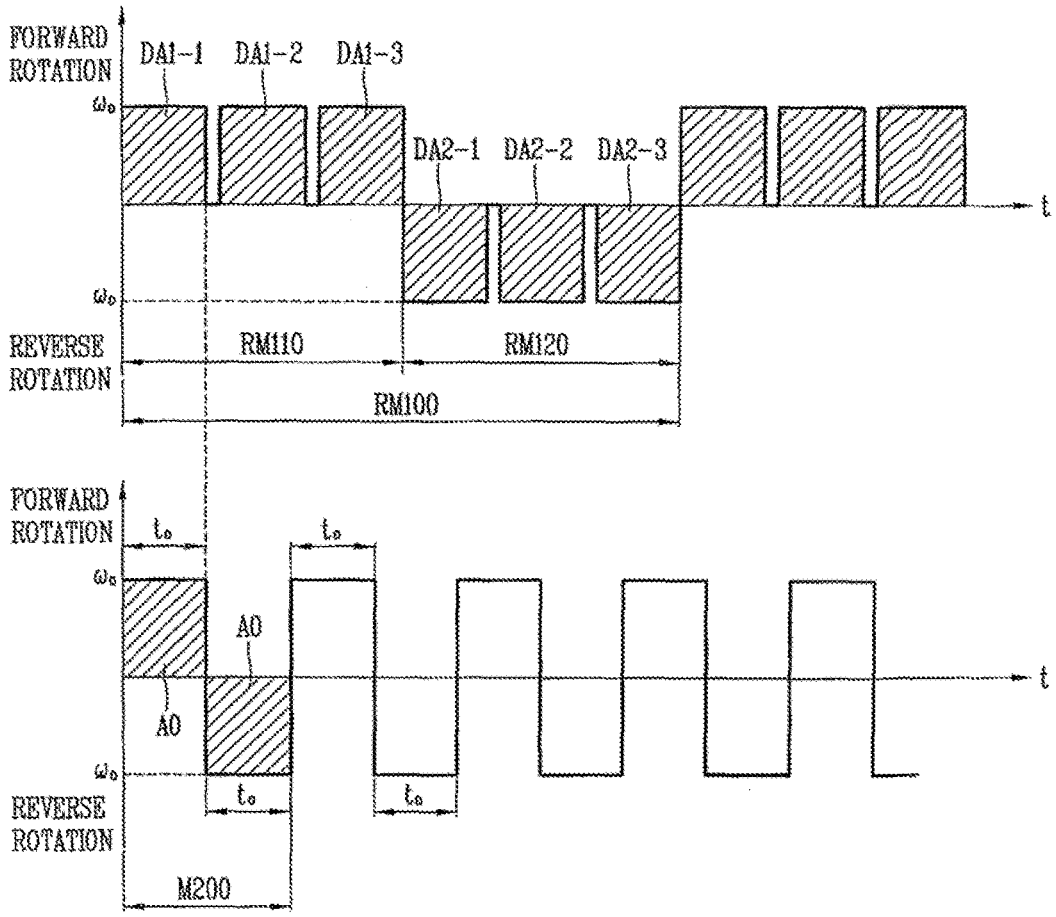
FIG. 12 is a diagram illustrating a three divisional rotation pattern of a pulsator according to Embodiment 5 of the present invention.

FIGS. 11(*a*) and 11(*b*) are diagrams illustrating a two divisional rotation pattern of a pulsator according to this embodiment, and FIG. 12 is a diagram illustrating a three divisional rotation pattern of a pulsator according to this embodiment.

According to an operation method of a washing machine according to this embodiment may include a divisional rotation mode (RM100) having a first divisional rotation process (RM110) of rotating the pulsator 160 with a first end angle (DA1) in one direction around the rotation shaft, and a second divisional rotation process (RM120) of rotating the pulsator with a second end angle (DA2) in the other direction, wherein the first divisional rotation process (RM110) divides the first end angle (DA1) into at least two angles to rotate the pulsator, and the second divisional rotation process (RM120) divides the second end angle (DA2) into at least two angles to rotate the pulsator.

Here, the one direction and the other direction designate a forward rotation and reverse rotation or a clockwise direction rotation and counter-clockwise directional rotation, respectively, around the rotation shaft 161 of the pulsator. However, it does not designate a specific directivity, but merely denotes that the forward and reverse rotations are sequentially carried out for the first process, and does not limit the rights scope of the present invention for the specific directivity.

The divisional rotation mode (RM100) may include a first divisional rotation process (RM110) and a second divisional rotation process (RM120).

Figure 13:
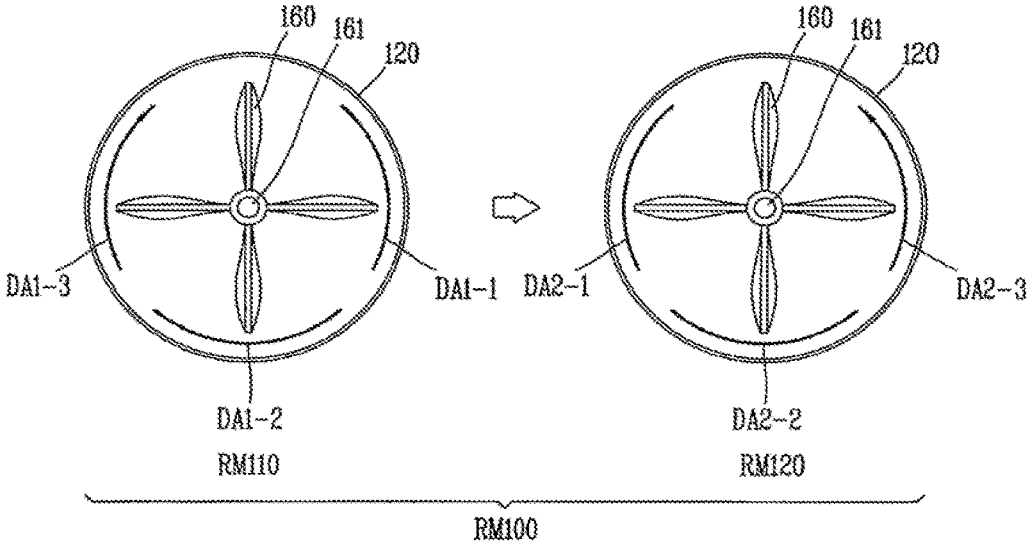
FIG. 13 is a schematic view illustrating the operation of a pulsator according to Embodiment 5 of the present invention.

Referring to FIG. 13, the first divisional rotation mode (RM110) is consisted of one direction rotation of the pulsator to finally rotate the pulsator in one direction with a first end angle (DA1). Furthermore, the second divisional rotation mode (RM120) is consisted of the other direction rotation of the pulsator to finally rotate the pulsator in the other direction with a second end angle (DA2). In FIG. 13, an arrow does not denote the size of a specific rotation angle but merely denote only a rotation direction and a relative size thereof.

Here, the first divisional rotation mode (RM110) divides the first end angle (DA1) into at least two angles to rotate the pulsator. Furthermore, the second divisional rotation mode (RM120) divides the second end angle (DA2) into at least two angles to rotate the pulsator. As such an example, FIG. 13 illustrates that the first end angle (DA1) and second end angle (DA2) are divided into three angles (DA1-1, DA1-2, DA1-3, DA2-1, DA2-2, DA2-3). In other words, an arrow indicating the rotation angle of the pulsator is divided into three angles in FIG. 13.

According to this embodiment having the foregoing configuration, power and energy transferred to cleaning objects to implement cleaning may be divided and transferred to the cleaning objects. If power is continuously transferred to cleaning objects to enhance cleaning effect, then the cleaning object may be damaged or excessively twisted to reduce cleaning effect, and thus the process is provided not to cause damage to the cleaning objects while transferring cleaning power. As a result, the cleaning objects may receive continuous acceleration and deceleration by dividing a rotation angle to implement cleaning while being slightly shaken within the tub by water flows, thereby preventing damage.

The division of the first and the second end angle may be carried out by suspending the rotation of the pulsator. FIG. 11(*a*) illustrates the rotation pattern of a pulsator in which the first and the second end angle are divided into two angles, respectively. Referring to FIGS. 11(*a*)-11(*b*), the first end angle (DA1) is divided into two angles (DA1-1, DA1-2) to provide an interval in which the pulsator is suspended between the divided angles. It is similarly applicable to the second end angle (DA2) divided into two angles (DA2-1, DA2-2). In FIGS. 11(*a*)-11(*b*), an area of the shaded region corresponds to each divided rotation angle of the pulsator. Meanwhile, when the first divisional rotation process (RM110) is switched to the second divisional rotation process (RM120) in FIGS. 11(*a*)-11(*b*), there is no interval in which the pulsator is suspended. In this case, the pulsator starts to perform a reverse rotation, thereby generating an effect similar to the suspension. However, when the first divisional rotation process (RM110) is switched to the second divisional rotation process (RM120), the pulsator may be suspended for a predetermined period of time. In other words, the pulsator may be suspended when the first divisional rotation process (RM110) is switched to the second divisional rotation process (RM120) similarly to suspending the pulsator when the first and the second end angle are divided.

FIG. 12 illustrates the rotation pattern of a pulsator in which the first and the second end angle are divided into three angles, respectively. Referring to FIG. 12, the first end angle (DA1) is divided into three angles (DA1-1, DA1-2, DA1-3) to provide an interval in which the pulsator is suspended between the divided angles. It is similarly applicable to the second end angle (DA2) divided into three angles (DA2-1, DA2-2, DA2-3). In FIG. 12, an area of the shaded region corresponds to each divided rotation angle of the pulsator. Meanwhile, when the first divisional rotation process (RM110) is switched to the second divisional rotation process (RM120) in FIG. 12, there is no interval in which the pulsator is suspended because the pulsator starts to perform a reverse rotation as described above, thereby generating an effect similar to the suspension. However, the pulsator may be suspended when the first divisional rotation process (RM110) is switched to the second divisional rotation process (RM120) similarly to suspending the pulsator when the first and the second end angle are divided.

Here, the first divisional rotation process may divide the first end angle into equal angles. Furthermore, the second divisional rotation process may divide the second end angle into equal angles. Furthermore, it may be configured such that the first end angle is equal to the second end angle. Such a configuration can provide various cleaning cycles to the user.

As a more specific example, as illustrated in FIG. 11(*a*), the first divisional rotation process may divide the first end angle into two equal angles to rotate the pulsator, and the second divisional rotation process may divide the second end angle into two equal angles to rotate the pulsator. As such an example, it may be configured such that the first end angle is 1440° and the second end angle is 1440°.

FIG. 11(*b*) shows a width of first divisional rotation process RM110 being wider than second divisional rotation process RM120.

Furthermore, as illustrated in FIG. 12, the first divisional rotation process may divide the first end angle into three equal angles to rotate the pulsator, and the second divisional rotation process may divide the second end angle into three equal angles to rotate the pulsator. As such an example, it may be configured such that the first end angle is 2160° and the second end angle is 2160°.

Meanwhile, the divisional rotation process (RM100) may be repeatedly carried out at least twice. In this case, as illustrated in FIGS. 11(*a*)-11(*b*) and 12, when the second divisional rotation process (RM120) is switched to the subsequently implemented first divisional rotation process (RM110), there is no interval in which the pulsator is suspended. However, it may be configured to further include the process of suspending the pulsator when the first divisional rotation process (RM110) is switched to the second divisional rotation process (RM120).

Here, the divisional rotation process (RM100) may be alternately implemented with the second cleaning mode (M200). In this case, it may be configured such that each of the divided angles (DA1-1, DA1-2, DA1-3, DA2-1, DA2-2, DA2-3) is equal to the general angle (A0). Referring to FIGS. 11 and 12, It may be understood by comparing an area corresponding to each divided angle with an area corresponding to the general angle (A0).

In order to improve the cleaning effect compared to the second cleaning mode with a typical rotation, such a configuration may reduce a twist of cleaning objects while transferring strong cleaning power and high energy to the cleaning objects, and change the posture and position of the cleaning objects, and prevent a crump of the cleaning objects, thereby allowing the cleaning objects to be uniformly distributed within the tub to slightly loosen them. Furthermore, the cleaning objects may be slightly shaken within the tub to implement cleaning.

Meanwhile, it may be configured to implement all the first, the second, the third, and the fourth cleaning mode with the speed variation mode and divisional rotation mode in a combined manner. The processes may be combined with one another in various ways according to the kind of cleaning objects and the progressive level of cleaning.

Although the preferred embodiments of the present invention have been described with reference to the accompanying drawings, the rights scope of the present invention should not be construed to limit the embodiments and/or drawings but determined in accordance with the appended claims. Furthermore, it should be clearly understood that various improvements, changes and modifications thereto made by those skilled in the art as disclosed in the accompanying claims will fall in the rights scope of the invention.

What is claimed is:

1. A method of operating a washing machine having a pulsator rotatably provided in a tub, the method comprising:

a divisional rotation mode having:

a first divisional rotation process of rotating the pulsator with a first end angle in one direction around a rotation shaft; and a second divisional rotation process of rotating the pulsator with a second end angle in the other direction around the rotation shaft, wherein the first end angle is greater than the second end angle, wherein the first divisional rotation process divides the first end angle into at least two angles to rotate the pulsator in the one direction, and wherein the second divisional rotation process divides the second end angle into at least two angles to rotate the pulsator in the other direction, wherein the first divisional rotation process includes suspending the pulsator between the two divided angles of the first end angle, and the second divisional rotation process includes suspending the pulsator between the two divided angles of the second end angle.

2. The method of claim 1, wherein the first divisional rotation process divides the first end angle into equal angles.

3. The method of claim 1, wherein the second divisional rotation process divides the second end angle into equal angles.

4. The method of claim 1, wherein a division of the first and the second end angle is implemented by suspending the rotation of the pulsator.

5. A method of operating a washing machine having a pulsator rotatably provided in a tub, the method comprising:

a first divisional rotation process of rotating the pulsator to a first end angle in one direction around a rotation shaft by separating the first end angle into at least two separate first angles in the one direction; and a second divisional rotation process of rotating the pulsator to a second end angle in another direction around the rotation shaft by separating the second end angle into at least two separate second angles in the other direction, wherein the first end angle is greater than the second end angle, wherein the first divisional rotation process includes suspending the pulsator between the two separated first angles of the first end angle, and the second divisional rotation process includes suspending the pulsator between the two separated second angles of the second end angle.

6. The method of claim 5, wherein the two separate first angles are equal angles.

7. The method of claim 5, wherein the two separate first angles are different angles from each other.

8. The method of claim 5, wherein in the first divisional rotation process, the two separate first angles are separated by an interval in which rotation of the pulsator is suspended.

9. The method of claim 5, wherein in the second divisional rotation process, the two separate second angles are separated by an interval in which rotation of the pulsator is suspended.

10. The method of claim 5, wherein a division of the first and second end angle is implemented by suspending the rotation of the pulsator.

11. The method of claim 5, the method comprising a cleaning mode in which the pulsator alternately performs forward and reverse rotations with a general angle around the rotation shaft.

12. The method of claim 5, wherein when the first divisional rotation process is changed to the second divisional rotation process, the pulsator is suspended for a predetermined period.

* * * * *